US006561164B1

(12) United States Patent
Mollin

(10) Patent No.: US 6,561,164 B1
(45) Date of Patent: May 13, 2003

(54) SYSTEM AND METHOD FOR CALIBRATING FUEL INJECTORS IN AN ENGINE CONTROL SYSTEM THAT CALCULATES INJECTION DURATION BY MATHEMATICAL FORMULA

(75) Inventor: Chad Mollin, Arlington Heights, IL (US)

(73) Assignee: International Engine Intellectual Property Company, LLC, Warrenville, IL (US)

( * ) Notice: Subject to any disclaimer, the term of this patent is extended or adjusted under 35 U.S.C. 154(b) by 0 days.

(21) Appl. No.: 10/039,387

(22) Filed: Oct. 29, 2001

(51) Int. Cl.[7] ..... F02M 37/04
(52) U.S. Cl. ..... 123/446; 73/119 A; 123/478
(58) Field of Search ..... 123/478, 480; 701/101–115; 73/119 A

(56) References Cited

U.S. PATENT DOCUMENTS 4,379,332 A 4/1983 Busser et al.
4,402,294 A 9/1983 McHugh et al.
4,619,234 A 10/1986 Okamoto
4,972,293 A 11/1990 Verner
5,575,264 A 11/1996 Barron
5,634,448 A 6/1997 Shinogle et al.
5,806,497 A 9/1998 Hosoya
5,839,420 A 11/1998 Thomas
6,112,720 A 9/2000 Matta

*Primary Examiner*—Thomas N. Moulis
(74) *Attorney, Agent, or Firm*—Dennis Kelly Sullivan; Susan L. Lukasik; Jeffrey P. Calfa

(57) ABSTRACT

A method of modifying a general formula that is used by an engine control system (10) to calculate duration of fuel injector actuation. Coefficients (P1 coeff., P2 coeff., ICP coeff.) of the formula are modified to calibrate individual fuel injectors (16) in an engine. The amount of calibration needed is determined by data that is marked on each fuel injector in electronically readable format after the fuel injector has been operated and its operating characteristic ascertained. The control system reads the marked data and then makes the proper coefficient adjustment.

6 Claims, 12 Drawing Sheets

SYSTEM AND METHOD FOR CALIBRATING FUEL INJECTORS IN AN ENGINE CONTROL SYSTEM THAT CALCULATES INJECTION DURATION BY MATHEMATICAL FORMULA

FIELD OF THE INVENTION

This invention relates generally to internal combustion engines having electric-actuated fuel injectors that inject fuel into combustion chambers of the engine. More particularly it relates to a system and method that uses several variables, including injector control pressure and the duration of an injector-actuation signal applied to the fuel injectors, in a process that calculates, by a mathematical formula, the quantity of fuel injected by a fuel injector during an injection, and that calibrates each fuel injector by adjustment of the formula.

BACKGROUND OF THE INVENTION

A known electronic engine control system comprises a processor-based engine controller that processes various data to develop fueling data for the engine. The fueling data represents a quantity of fuel that is to be introduced into the engine for combustion. That control system also includes an injector control module, or injector driver module, for operating fuel injectors that inject fuel into the engine in quantities corresponding to the fueling data. The fueling data is supplied to the injector control module from the engine controller, and the injector control module has its own processor for processing the supplied data to develop proper data for causing the fuel injectors to inject fuel in quantities corresponding to the fueling data calculated by the engine controller. For any one or more of various reasons that need not be discussed here, the injector control module may also make certain adjustments to the supplied data when the engine control strategy and/or injector calibration make it appropriate to do so.

The injector control module also comprises injector drivers each of which delivers an electric current signal to an electric actuator of the respective fuel injector. A fuel injector may have one or more electric actuators depending on its particular construction. The signal that is applied to a fuel injector to cause an injection of fuel is commonly referred to generically as a pulse width modulated signal. In the case of a fuel injector that has a single actuator, the actuating signal is a true pulse whose width sets the amount of time of an injection, and hence essentially determines the quantity of fuel that the fuel injector injects into the corresponding engine cylinder in consequence of that applied pulse. In the known engine controller that is being referred to, it is the injector control module that calculates the pulse width by processing the fueling data supplied to it by the engine controller.

The particular nature of the electric actuation of any particular fuel injector depends on the particular construction of the fuel injector. There is the single actuator type mentioned above. Another type of fuel injector, one for a compression-ignition internal combustion engine, comprises an intensifier piston for creating a high-pressure injection of fuel directly into an associated engine cylinder. The intensifier piston comprises a head of given end area exposed to a control fluid, oil for example, in a control chamber, and a plunger, or rod, of smaller end area exposed to liquid fuel in an injection chamber. The electric actuator comprises a spool valve that uses two electric actuators, i.e. solenoid coils, to control the introduction of pressurized control fluid into the control chamber and the draining of control fluid from the control chamber.

When an electric signal for initiating a fuel injection is applied to one of the two electric actuators for the spool valve, control fluid is introduced under pressure through one portion of the spool valve into the control chamber to downstroke the intensifier piston and cause fuel in the injection chamber to be injected under pressure from a nozzle of the fuel injector into an associated engine cylinder. The intensifier piston amplifies the pressure of the control fluid by a factor equal to the ratio of the head end area to the plunger end area to cause the amplified pressure to be applied to liquid fuel in the injection chamber. As a result, fuel is injected into a combustion chamber at a pressure substantially greater than the pressure of the control fluid.

When an electric signal for terminating the fuel injection is applied to the other electric actuator, the spool valve operates to terminate the downstroke of the intensifier piston and instead allow control fluid to drain from the control chamber through another portion of the spool valve so that the intensifier piston can then upstroke to re-charge the injection chamber with liquid fuel in preparation for the next injection.

Examples of fuel injectors having valves like those just described appear in U.S. Pat. Nos. 3,837,324; 5,460,329; 5,479,901; and 5,597,118.

Where a single electric actuator controls a fuel injector valve, the beginning of an electric pulse applied to the actuator initiates an injection, and the injection terminates when the pulse ends. The injection time is therefore set by the width, i.e. time duration, of the actual electric pulse applied to the injector actuator.

Commonly assigned U.S. Pat. No. 6,029,628 is an example of a fuel injector comprising two electric actuators that operate respective valve mechanisms. A supply valve mechanism is controlled by an electric supply valve actuator for selectively controlling flow of control fluid through a supply passage for downstroking an intensifier piston. A drain valve mechanism is controlled by an electric drain valve actuator for selectively controlling flow of control fluid through a drain passage. Each valve actuator is selectively operable independent of the other to selectively operate the respective valve mechanism independent of the other. Actuation of the supply valve mechanism while the drain valve mechanism is not being actuated initiates an injection, and the injection terminates when the drain valve mechanism is actuated.

The use of two electric signals, each applied to a respective one of the two actuators, to set the duration of a fuel injection is like that described previously for the fuel injector that has two actuators for operating a spool valve because the difference between the times at which the two actuators are actuated, rather than the time duration of an actual electric pulse, controls the duration of an injection. But the two signals in effect define a pulse width for operating the fuel injector that is equivalent to the pulse width of a single pulse signal that determines the injection time of a fuel injector that has only a single electric actuator. Hence, reference to pulse width in a generic context should be understood to include an actual pulse width of a single signal or an equivalent pulse width resulting from the use of one signal to initiate an injection and another signal to terminate the injection.

The known engine controller also contains one or more look-up tables that its processor uses to calculate the desired fueling data, which is then processed to calculate the widths of electric pulses that operate the fuel injectors. The look-up tables are derived from actual testing of fuel injectors. Fuel injectors are mapped for various combinations of values for injector control pressure and actuating signal pulse width. Each combination of values defines a corresponding value for desired fueling data. A sufficient number of combinations are needed to cover the relevant ranges of the variables, but the available size of the look-up tables ultimately determines how many combinations can actually be stored in memory of the controller.

While increasing look-up table size, and hence the number of combinations that can be stored, will endow the tables with a higher degree of resolution that may be desirable for increased fueling accuracy, the increased size of the electronic storage medium that is required to contain the stored data increases the cost of the controller. A greater amount of mapping is also required in order to obtain the greater amount of data.

A lesser number of stored combinations may decrease the resolution, and hence decrease fueling accuracy. The processor may then on occasion have to interpolate the mapped data in order to yield desired fueling data, and where non-linearity is present in the fuel injector, linear interpolation may not yield the accuracy that would be obtained from a larger table of greater resolution.

Regardless of fuel injector type or of how fuel injector data is mapped into a controller, fuel injector calibration is also important for securing desired fueling. Mass production methods inherently result in some variation in calibration from fuel injector to fuel injector, and while such methods may strive to minimize the range of these variations, the ranges remain significant enough that some classification of fuel injectors according to a number of different calibration categories, or groups, is appropriate in a mass production environment. The mapping of fuel injector data that has been described above may therefore represent mean data obtained from mapping a number of individual fuel injectors statistically representative of a universe of fuel injectors, in which case the calculated fueling data may be further processed to account for individual fuel injector calibration.

Hence, before it is assembled to an engine, a mass-produced fuel injector is operated to ascertain its actual calibration. The actual calibration determines into which particular one of a number of different calibration categories the fuel injector falls. The fuel injector is then identified by that particular category. When an engine is being manufactured, the associated engine controller is programmed in such a way that the particular calibration category of the fuel injector for each particular engine cylinder is made available to the controller. The controller uses that data to calibrate electric control signals to the fuel injectors, typically to secure injection of fuel in substantially equal quantities to each combustion chamber for a given value of fueling data calculated by the engine controller.

U.S. Pat. No. 5,575,264 discloses a method for associating actual performance data with a fuel injector. The data is contained in a medium, such as an EEPROM, that is mounted on the fuel injector body and that is suitable for reading by an associated engine controller.

U.S. Pat. No. 5,839,420 relates to a method for compensating a fuel injection system for fuel injector variability. Each fuel injector includes a storage medium that contains a calibration code identifying the actual calibration of the fuel injector. An associated engine controller converts a raw energizing time to a calibrated energizing time for each fuel injector based the calibration code for the fuel injector.

U.S. Pat. No. 5,634,448 relates to another method for trimming fuel injectors to compensate for fuel injector variability.

U.S. Pat. No. 4,402,294 relates to a system for calibrating fuel injectors.

Other patents that relate to systems and methods for calculating engine fueling and/or correcting the calculation for factors such as individual fuel injector calibration are U.S. Pat. No. 4,379,332; U.S. Pat. No. 4,619,234; and U.S. Pat. No. 5,806,497.

Given the significant effort that is needed to map and calibrate fuel injectors, and the amount of media needed to store a sufficient amount of mapped data to cover relevant ranges of variable parameters affecting engine fueling, as discussed above, it would be desirable to provide a system and a method that reduce the extent of the mapping effort and of the amount of data storage that is needed. The inventor's commonly assigned patent application "SYSTEM AND METHOD FOR PREDICTING QUANTITY OF INJECTED FUEL AND ADAPTATION TO ENGINE CONTROL SYSTEM", Ser. No. 10/003,980, filed Oct. 31, 2001, relates to such a system and method.

SUMMARY OF THE INVENTION

The present invention is a further invention resulting from the invention of Ser. No. 10/003,980, and concerns calibration of fuel injectors in an engine control system that calculates injection duration by mathematical formula.

Accordingly, a generic aspect of the present invention relates to a method of calibrating an electric-actuated fuel injector for an,engine that uses injector control pressure to inject the fuel from the injector into the engine. Before the fuel injector is installed in the engine, it is electrically actuated by a predetermined electric actuation at a first predetermined injector control pressure. The resulting quantity of fuel injected is measured. It is again electrically actuated by the predetermined electric actuation but now at a second predetermined injector control pressure. The resulting quantity of fuel injected is measured. The measured quantities, the predetermined injection control pressures, and the applied predetermined electric actuation are correlated with values of quantity of fuel injected, injector control pressure, and electric actuation that are related by a predetermined multiple term mathematical formula to ascertain, for the same quantities of injected fuel at each predetermined injector control pressure, difference between the applied predetermined electric actuation and that required by the formula.

Another generic aspect of the present invention relates to a system that comprises apparatus for performing the method just described.

Still another generic aspect of the present invention relates to an internal combustion engine comprising one or more electric-actuated fuel injectors each of which injects fuel into a respective combustion chamber of the engine as a function of injector control pressure and the duration of an electric actuating signal that sets the duration of a fuel injection to achieve an injection quantity determined at least in part by a desired fueling data representing desired fueling of the engine. An engine control system comprises one or more processors that calculate the desired fueling data, and from the desired fueling data, the duration of the electric actuating signal for each fuel injector by processing the desired fueling data and data representing injector control pressure, including processing, according to a mathematical formula, data correlated with the desired fueling data and data representing injector control pressure, to develop data that the control system further processes to calculate the duration of the electric actuating signal. Each fuel injector is marked with data that is entered into the engine control system incidental to installation of the fuel injector in the engine and that defines difference between the operating characteristic of the fuel injector and that of a general fuel injector on which the multiple term mathematical formula is based. The control system modifies the formula for each fuel injector according to the marked data on each fuel injector to thereby calibrate each fuel injector in the engine so that each fuel injector injects fuel substantially in accordance with desired fueling data that is calculated by the control system and then is used in the formula as the quantity of injected fuel.

The foregoing, along with further features and advantages of the invention, will be seen in the following disclosure of a presently preferred embodiment of the invention depicting the best mode contemplated at this time for carrying out the invention. This specification includes drawings, now briefly described as follows.

DESCRIPTION OF THE PREFERRED EMBODIMENT

Figures 1, 1A:
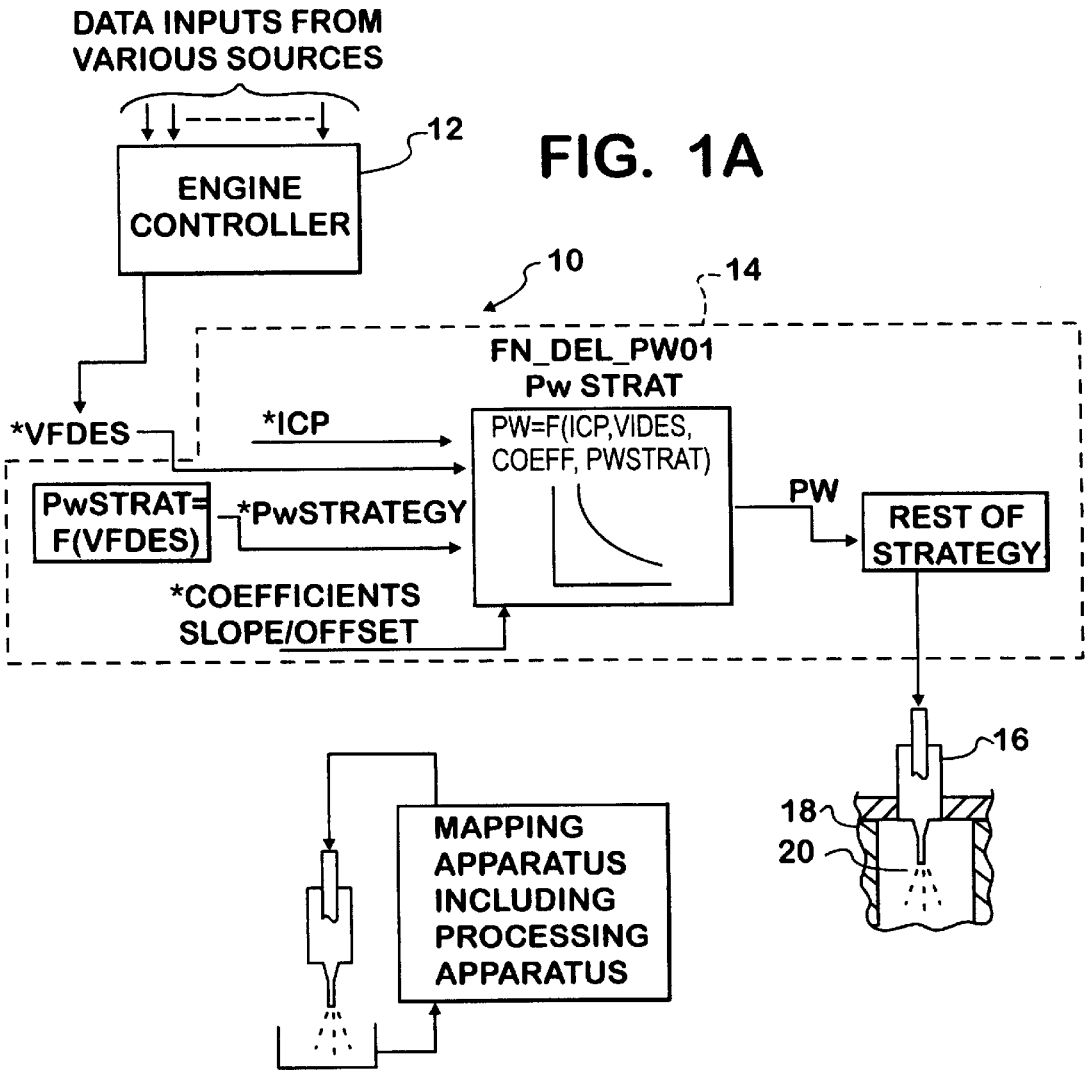
FIG. 1 is a general schematic diagram of an exemplary embodiment of certain apparatus used in measuring the actual calibration of a fuel injector.
FIG. 1A is a general schematic diagram of an exemplary engine and control system embodying principles of the present invention.

FIG. 1A shows a schematic diagram of an exemplary engine control system 10 that utilizes results from a method that will subsequently be described with reference to FIG. 1. Control system 10 comprises a processor-based engine controller 12 and an injector control module, or injector driver module, 14 for controlling the operation of electric-actuated fuel injectors 16 that inject fuel into combustion chambers of an internal combustion engine 18, such as in a multi-cylinder, compression-ignition internal combustion engine that powers an automotive vehicle. Although FIG. 1A shows an arrangement for only one cylinder 20, a respective fuel injector 16 is associated with each cylinder. Each fuel injector comprises a body that is mounted on the engine and has a nozzle through which fuel is injected into the corresponding engine cylinder.

Controller 12 operates each fuel injector 16 via injector control module 14, causing a respective driver circuit (not shown) in module 14 to actuate the respective fuel injector at the appropriate time in the engine operating cycle. The processor of controller 12 processes various items of data to develop data representing desired quantities of fuel to be injected by the individual fuel injectors. Such data will be referred to as desired fueling data represented by the symbol vfdes. The desired fueling data is supplied to injector control module 14, which may have its own processor for perform further processing of the supplied data to develop data that is in turn converted to corresponding electric signals for the injector drivers that operate the fuel injectors. Data representing the present injector control pressure ICP is also available to injector control module 14.

Each fuel injector 16 comprises an electric-actuated injection mechanism, such as one of the types described earlier. A fuel injection from an injector is initiated by an initiating electric signal applied to the fuel injector by the respective driver circuit. The fuel injection terminates when the electric signal changes to a terminating electric signal. The initiating electric signal may be the leading edge of a rectangular pulse, and the terminating signal, the trailing edge in the case of an injector that has a single electric actuator. The time between the edges is the pulse width, which may be modulated according to the amount of fuel to be injected. Therefore, when a true pulse width modulated signal is used to operate the fuel injector, using the leading edge of a pulse as an injection-initiating signal and the trailing edge as an injection-terminating signal, the timing of the initiating and terminating electric signals determines the quantity of fuel injected, and the actual pulse width may be adjusted to take into account other data that at certain times is appropriate to use in making some adjustment of vfdes.

Injector control module 14 may therefore at times make certain adjustments to the desired fueling data vfdes received from controller 12 for developing the pulse widths of the electric current signals supplied to the fuel injectors. One reason for injector control module 14 to make an adjustment of the desired fueling data that is supplied from controller 12 is to compensate for certain characteristics of the specific fuel injectors, such as the injector calibration mentioned above, and that is the subject of the present invention. Another reason for adjustment of the desired fueling data, a reason that need not be discussed here, is to compensate for prevailing conditions that otherwise would contribute to deviation of the actual amount of fuel injected from the desired amount, such as a cold start for example.

The desired fueling data vfdes supplied to injector control module 14 represents a certain pulse width for the signal to be applied to a fuel injector to deliver a corresponding amount of fuel to the engine cylinder based on some set of base conditions for the engine and ambient.

In the case of a fuel injector that has two electric actuators, one of which is energized to initiate a fuel injection and the other of which is energized to terminate the fuel injection, a respective signal is applied to each actuator. However, as explained above, the difference in time between the applications of the two signals is equivalent to a pulse width of a single electric actuating signal. Further description of the invention with reference to the drawing Figures is premised on the fuel injectors being of the two-actuator type.

The invention of Ser. No. 10/003,980 relates to a system and method of deriving a formula for calculating a quantity of fuel injected by each such fuel injector 16. The method comprises mapping a representative fuel injector 16 by applying various combinations of different selected hydraulic fluid pressures and different selected durations of the electric actuating signal. For each combination, the quantity of fuel injected is measured to create a corresponding data set for the combination. Each data set comprises the corresponding selected hydraulic fluid pressure, the corresponding selected electric signal duration, and the quantity of fuel injected in consequence of the application of the corresponding selected hydraulic fluid pressure and the corresponding selected electric signal duration to the fuel injector. The mapping apparatus is shown generally in FIG. 1 and includes various pieces of measuring equipment and processing apparatus.

Because the fuel injector of the example has two electric actuators, a first signal P1 is used to initiate a fuel injection by energizing one of the two actuators, and a second signal P2 is used to terminate the fuel injection by energizing the other of the two actuators. Hence, the result of the mapping comprises a number of data sets each containing P1 data, P2 data, injector control pressure data, and injected fuel quantity data. The data sets are then sorted into groups such that the injector control pressure data for the data sets of a given group is the same. A multiple linear regression is conducted on the data in each group. The following is an example of an actual mapping undertaken on a particular fuel injector. (A multiple polynomial regression can be undertaken injector control pressures that occur within a pressure range, low injector control pressures for example, where linearity is questionable.)

The equations used for the multiple linear regression are given below as taken from *Probability and Statistics for Engineers and Scientists*, Walpole and Myers. ($2^{nd}$ edition 1978, $3^{rd}$ edition 1985, MacMillan, N.Y., N.Y.).

$$nb_o + b_1\sum_{i=1}^{n} x_{1i} + b_2\sum_{i=1}^{n} x_{2i} + b_3\sum_{i=1}^{n} x_{3i} = \sum_{i=1}^{n} y_i$$

$$b_o\sum_{i=1}^{n} x_{1i} + b_1\sum_{i=1}^{n} x_{1i}^2 + b_2\sum_{i=1}^{n} x_{1i}x_{2i} + b_3\sum_{i=1}^{n} x_{1i}x_{3i} = \sum_{i=1}^{n} x_{1i}y_i$$

$$b_o\sum_{i=1}^{n} x_{2i} + b_1\sum_{i=1}^{n} x_{1i}x_{2i} + b_2\sum_{i=1}^{n} x_{2i}^2 + b_3\sum_{i=1}^{n} x_{2i}x_{3i} = \sum_{i=1}^{n} x_{2i}y_i$$

$$b_o\sum_{i=1}^{n} x_{3i} + b_1\sum_{i=1}^{n} x_{1i}x_{3i} + b_2\sum_{i=1}^{n} x_{2i}x_{3i} + b_3\sum_{i=1}^{n} x_{3i}^2 = \sum_{i=1}^{n} x_{3i}y_i$$

where x1=P1, x2=P2, x3=injector control pressure, n=the number of measurements, and y=injected fuel quantity.

The equations are then solved for $b_0$, $b_1$, $b_2$, and $b_3$ at three different injector control pressures, those pressure being 6 Mpa, 12 Mpa, and 24 Mpa in the example. This resulted in the following equations for injected fuel quantity (fuel volume per injection, or stroke):

$$@\ 6\ \text{Mpa:}\ Fuel\left(\frac{\text{mm}^3}{\text{Stroke}}\right) = -27.622 + 0.018 * P_1 + 0.036 * P_2 - 0.029394$$

$$@\ 12\ \text{Mpa:}\ Fuel\left(\frac{\text{mm}^3}{\text{Stroke}}\right) = -32.51 + 0.021 * P_1 + 0.057 * P_2 - 1.8775$$

$$@\ 24\ \text{Mpa:}\ Fuel\left(\frac{\text{mm}^3}{\text{Stroke}}\right) = -18.391 + 0.025 * P_1 + 0.082 * P_2 - 8.8671$$

Figure 2:
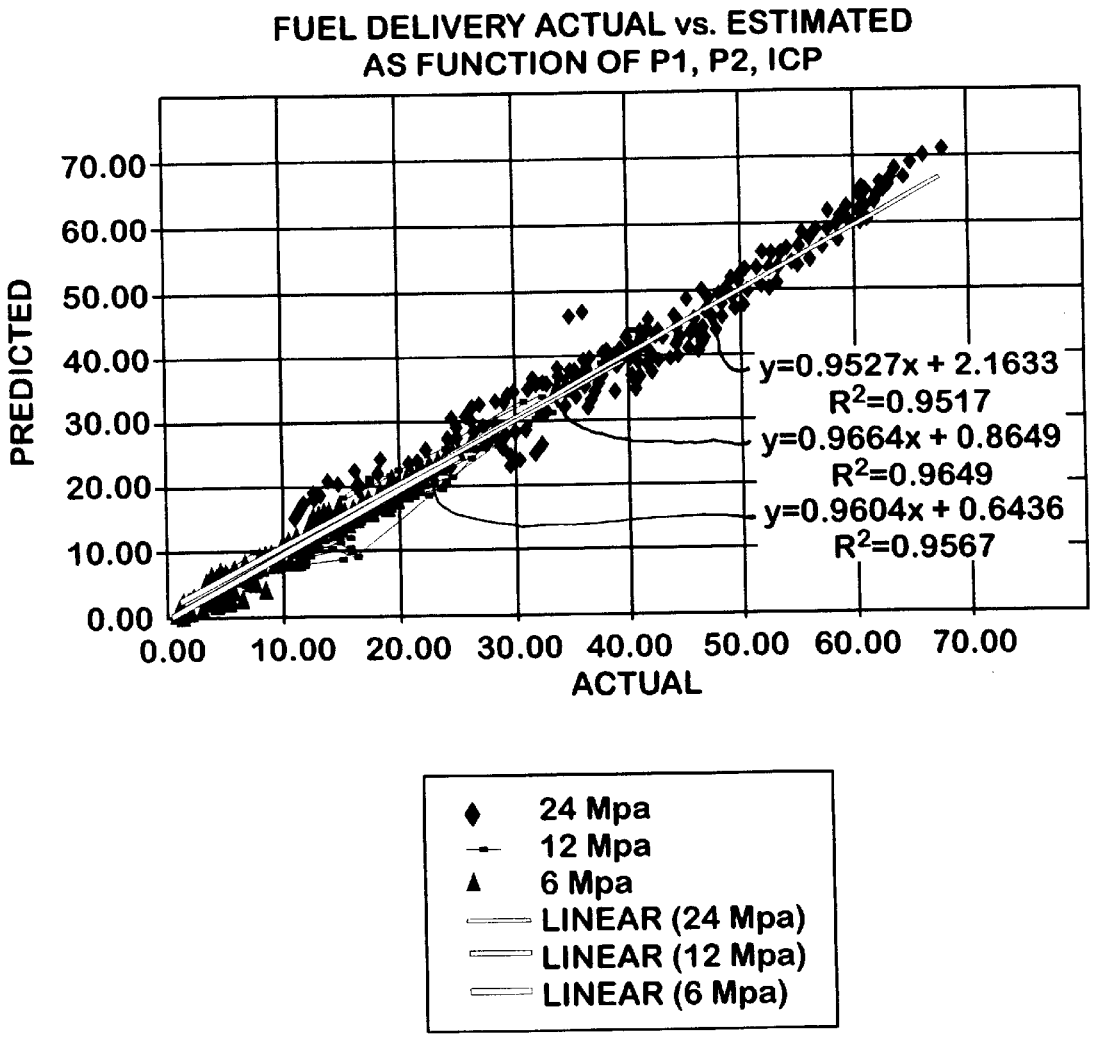
FIG. 2 is a graph showing an example that illustrates certain steps involved developing a general formula for calculating quantity of fuel injected by a fuel injector.

Plotting the actual data for each of the three injector control pressures vs. their respective predicted values gives the correlation agreement shown in FIG. 2. As can be seen from the substantial 45 degree line fit, the correlations on an individual basis are quite good, approximately 95%–96% confidence.

Figure 3:
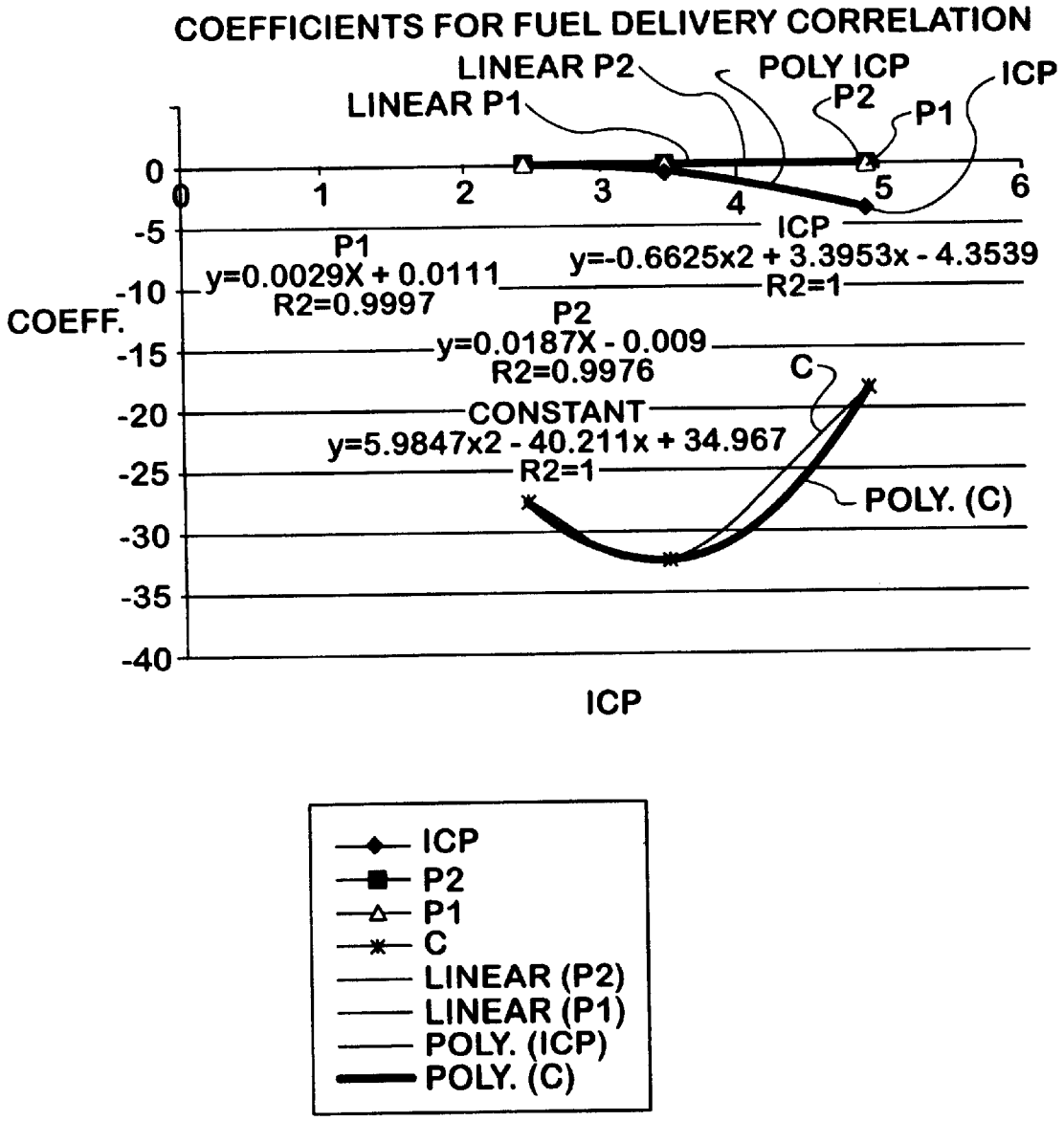
FIG. 3 is a graph showing additional steps.
Figure 3A:
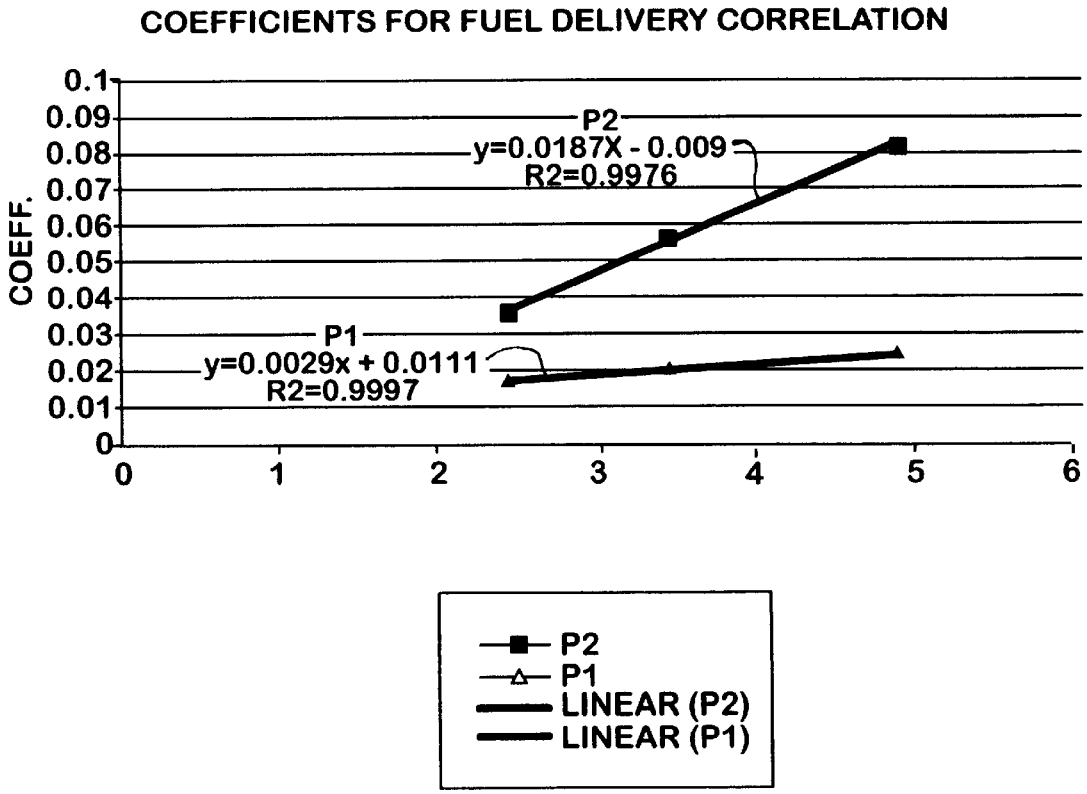
FIG. 3A shows a portion of FIG. 3 on a larger scale.

Because it is considered impractical to implement an infinite number of equations each of which would represent one of an infinite number of possible injected fuel quantities, the next step in the example involves determining the equations which best represent,the individual coefficients. This can be done by plotting the coefficients vs. injector control pressure for best fit as shown in FIGS. 3 and 3A.

From the equations for the line fits of the coefficients vs. injector control pressure, the following equations for the coefficients were obtained:

$$Constant = 5.9847 * ICP - 40.211 * \sqrt{ICP} + 34.967$$

$$P1Coeff. = 0.0029 * \sqrt{ICP} + 0.011$$

$$P2Coeff. = 0.0187 * \sqrt{ICP} - 0.009$$

$$ICPCoeff. = -0.6625 * ICP + 3.3953 * \sqrt{ICP} - 4.3539$$

And then by applying the coefficients to terms of an equation and including a shift factor, the following generalized equation for injected fuel quantity was developed:

$$FuelDelivery\left(\frac{\text{mm}^3}{\text{Stroke}}\right) = 13 + \left(5.9847 * ICP - 40.211 * \sqrt{ICP} + 34.967 + \left(0.0029 * \sqrt{ICP} + 0.011\right) * P_1 + \left(0.0187 * \sqrt{ICP} - 0.009\right) * P_2 + \left(-0.6625 * ICP + 3.3953 * \sqrt{ICP} - 4.3539\right) * \sqrt{ICP}\right.$$

Hence the foregoing shows that data from the data sets was processed to create terms of a multiple term mathematical formula that can be used to calculate the quantity of fuel injected, wherein the terms of the formula include as variables, the electric signal duration and the hydraulic fluid pressure.

Figure 4:
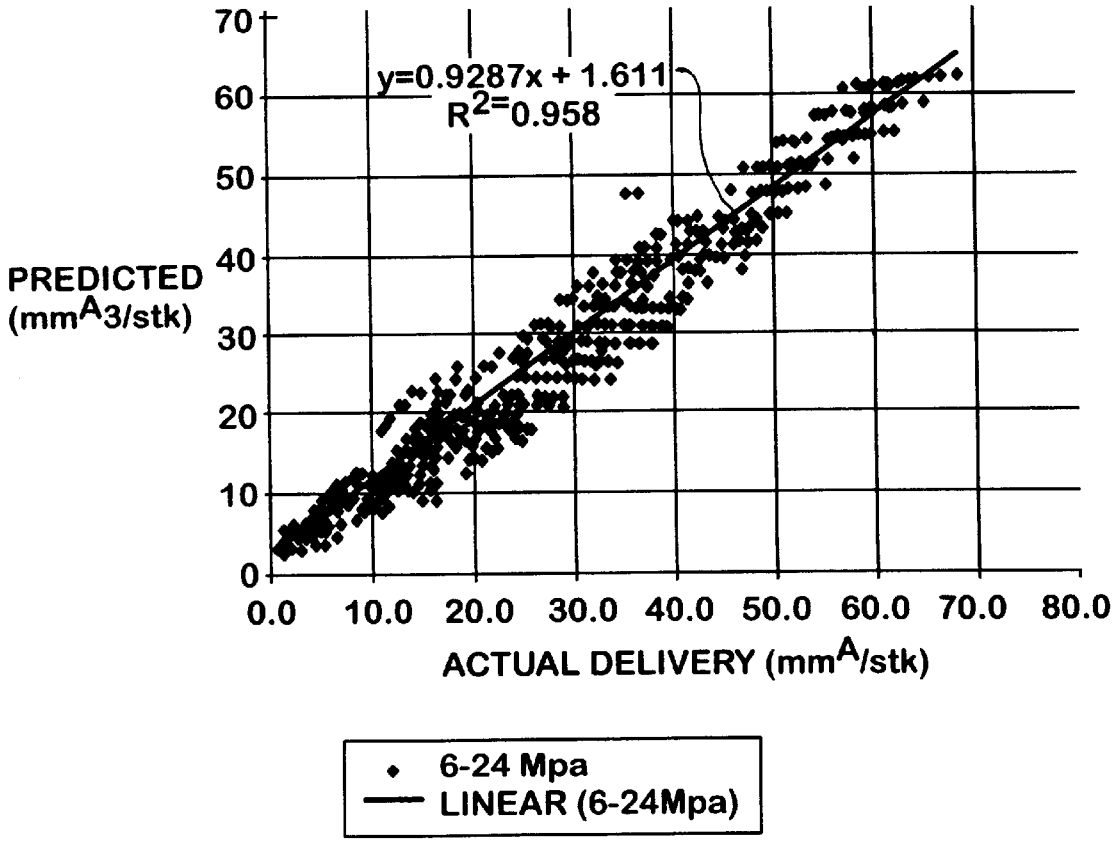
FIG. 4 is a graph showing correlation of actual fueling measurements with calculated desired fueling derived through use of the inventive principles.

FIG. 4 verifies that the method of using the general equation, or formula, derived according to the inventive method, can calculate, with satisfactory accuracy, injected fuel quantity based on P1, P2, and injector control pressure for this type of injector within specified operating ranges.

It is to be understood that each particular type of fuel injector may require development of its own unique general equation, but fuel injectors of the same type can be calibrated to an engine control system in accordance with principles of the present invention.

Figure 5:
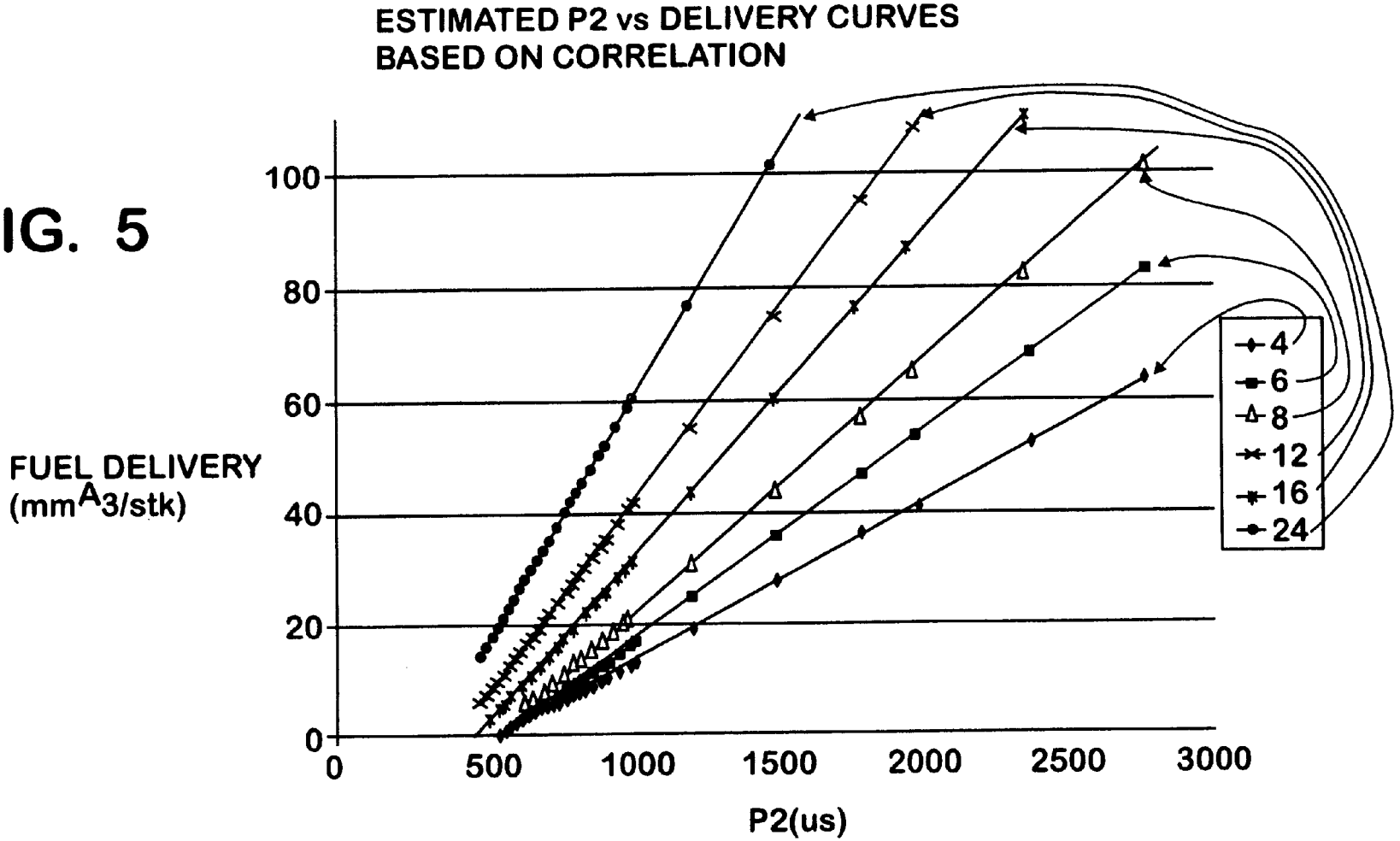
FIG. 5 is a graph showing the relationship between desired fueling and pulse width for several different injector control pressures.

The correlation shown by FIG. 5 is based on the linear segment for pressures between 6 and 24 Mpa in the particular example. Accuracy below 6 Mpa and at maximum fuel deliveries is problematic due to injector control pressure fluctuations as well as factors that create non-linear conditions, and for such reasons, a multivariable polynomial regression may be required, as noted earlier.

Figure 6:
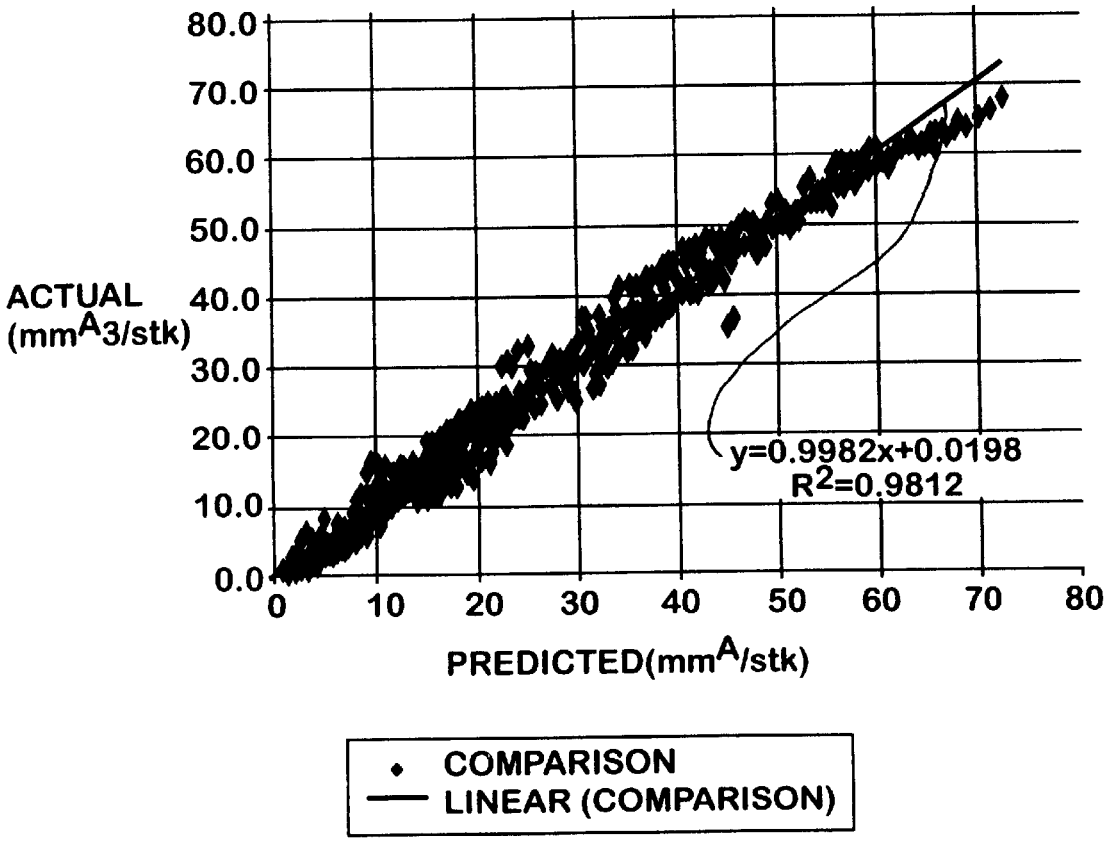
FIG. 6 is a graph similar to FIGS. 2 and 4, but with axes reversed, showing correlation of actual fueling measurements with calculated desired fueling derived through further refinement of the general equation.

Using the statistical software known as SIGMA PLOT, it is possible to improve upon the general equation by using the non-linear regression model. Use of non-linear regression is premised upon having derived the general equation, as described above. The general equation is entered into the SIGMA PLOT software as well as data sets for the three independent variables (P1, P2, and injector control pressure) and the one dependent variable (injected fuel quantity), and the curve fit was tightened. The improved correlation agreement is shown in FIG. 6. An $R^2$ value of 98% was found.

The refined equation is given as:

$$FuelDelivery\left(\frac{mm^3}{Stroke}\right) = 13 + \left(7.217 * ICP - 47.78 * \sqrt{ICP} + 34.967\right) + \left(0.008461 * \sqrt{ICP} + 0.011\right) * P_1 + \left(0.01866 * \sqrt{ICP} - 0.009\right) * P_2 + \left(-0.9927 * ICP + 4.628 * \sqrt{ICP} - 4.3539\right) * \sqrt{ICP}$$

The development of a single empirical equation that can predict fuel deliveries over a range of 6–24 Mpa with a correlation agreement of 98% is believed to afford opportunities to engine control strategy designers and engine calibrators to significantly simplify control strategy and calibration procedures.

Processors of engine control systems can process data sufficiently fast to calculate, in real time, the duration of injector actuation using the above general equation or its refined version. In such case, the control system is programmed with either equation, but with the equation rearranged to solve for P2. The engine controller processes certain data that is relevant to calculating desired engine fueling in terms of quantity of fuel injected per injection, or stroke of a fuel injector. The calculated data representing desired engine fueling is compared to a predefined limit that is contained in the control system. The control system selects a predetermined constant as data for P1 when the desired fueling data exceeds the predefined limit, but equates P1 to P2 by substituting P2 for P1 in the formula when the desired fueling data is equal to or less than the predefined limit. The result of the processing is data that defines a value for P2, that in conjunction with the data for P1, defines the duration of a fuel injection that will cause the quantity of fuel injected during the injection at the prevailing injector control pressure ICP to be substantially equal to the desired fueling, ignoring for the moment possible adjustment due to factors that may call for some adjustment, as mentioned earlier, to compensate for certain influences. Even when adjustment is made, the actual quantity injected is determined at least in substantial part by the general formula, or its refined version, as rearranged to develop data for setting the duration of injector actuation to produce one injection of fuel.

Figure 7:
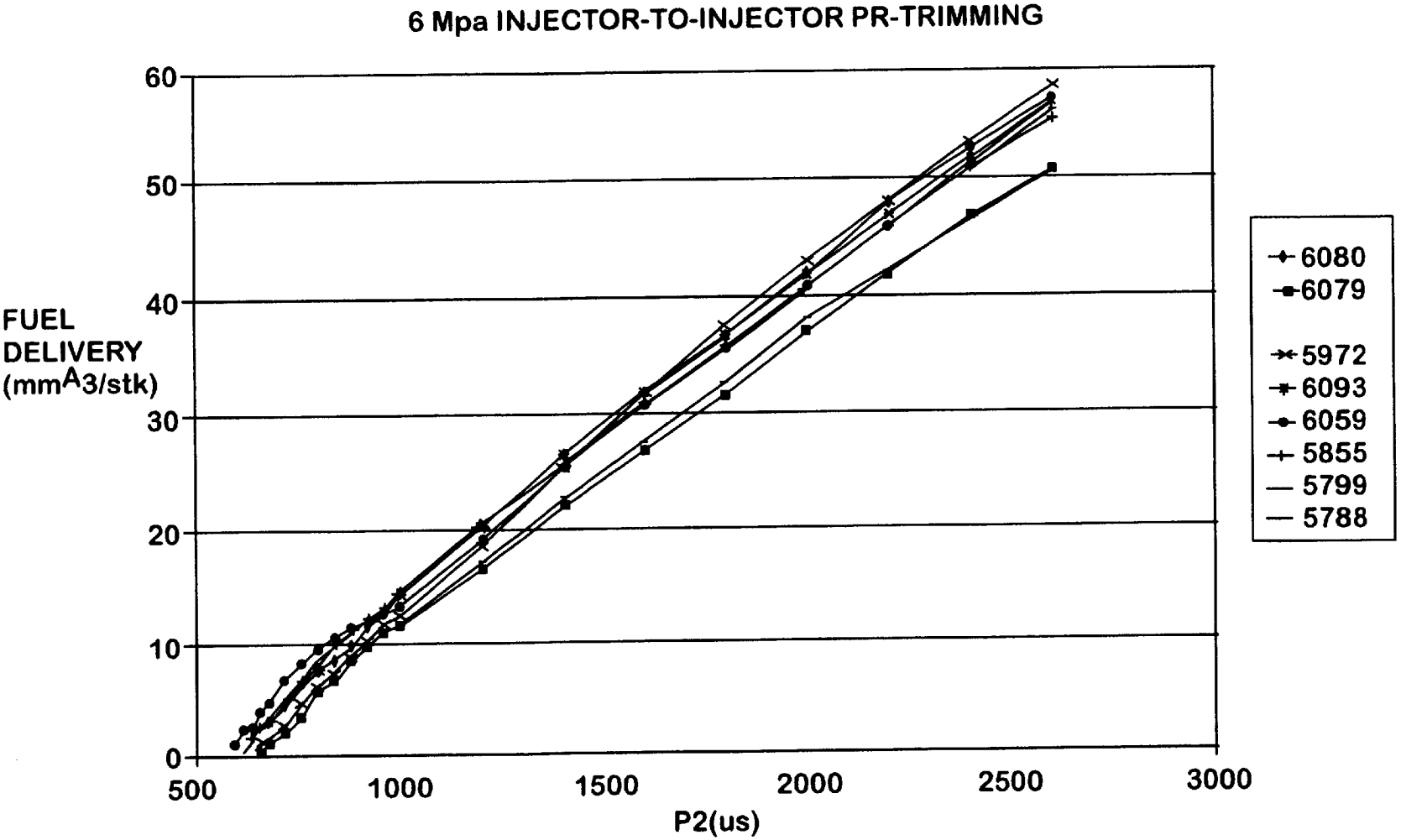
FIGS. 7–11 are graphs of operating characteristics of several fuel injectors useful in explaining principles of the invention.

The present invention tailors the general formula, or its refined version, to take into account the particular calibration of each fuel injector in an engine. FIG. 7 shows the injection At characteristic for each of several fuel injectors of the same type for an injector control pressure of 6 Mpa. As can be seen, the characteristic is subject to injector-to-injector variation, due essentially to slight variations in manufacture employing mass production techniques.

Figure 8:
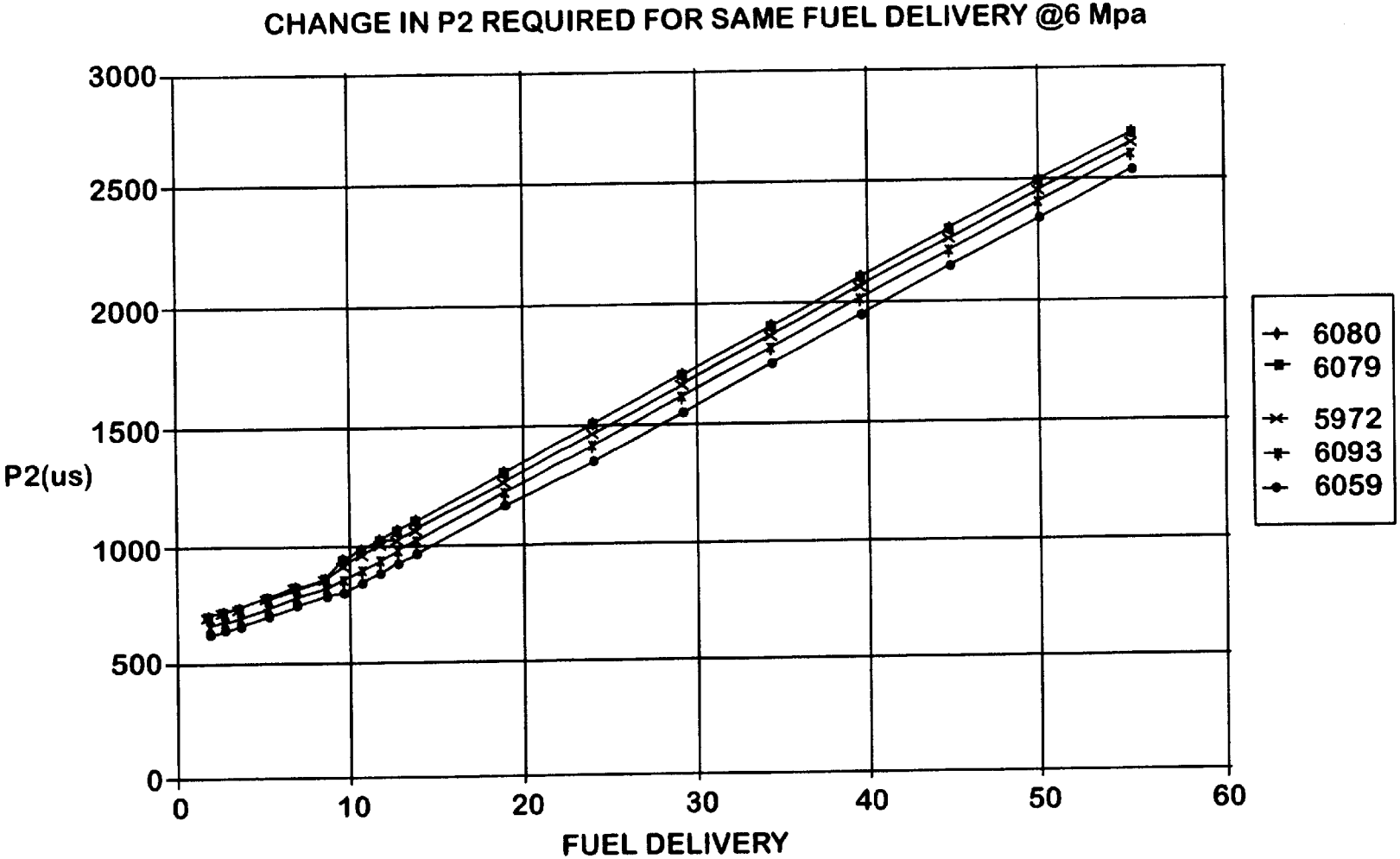

FIG. 8 shows how the variable P2 must change for each fuel injector in order for all fuel injectors to deliver the same quantity of fuel per injection for a given desired fueling vfdes.

In accordance with the inventive method, each fuel injector is operated at the conclusion of its manufacture, and certain measurements are made. A specific example comprises operating a fuel injector at a certain higher injector control pressure and at a certain lower injector control pressure with the same electric actuating signal and measuring the quantity of fuel injected in each instance. The two measurements would described a straight line on a graph plot of quantity of injected fuel vs. injector control pressure. This straight line is then compared with a straight line calculated by using the general formula. Substantial coincidence of the two lines would not call for any adjustment of the general formula for this particular fuel injector when the fuel injector is operating in an engine. Lack of substantial coincidence would call for an appropriate adjustment.

An appropriate adjustment is made by making certain changes in certain coefficients of the general formula that will result in values of P2 that when applied to this particular fuel injector, will secure its proper calibration in the engine. In order for the associated engine control system to provide those coefficient changes, the fuel injector is marked in a certain manner to identify how the coefficients should be modified. Marking is preferably done electronically in a way that allows the engine control system to electronically read the marked data and cause the modified coefficients to be used in the general formula whenever data for P2 is calculated for this particular fuel injector.

Figure 9:
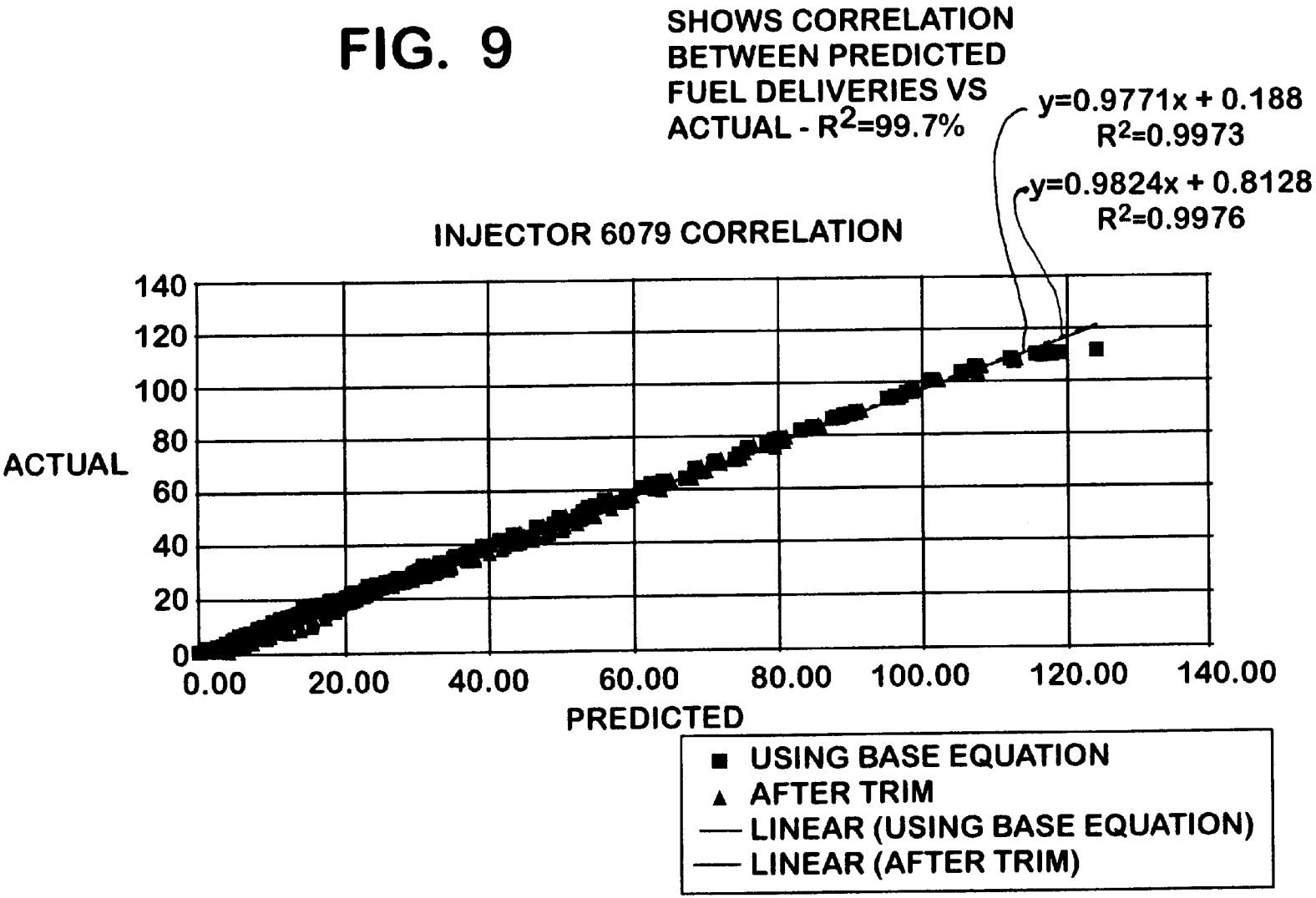
Figure 10:
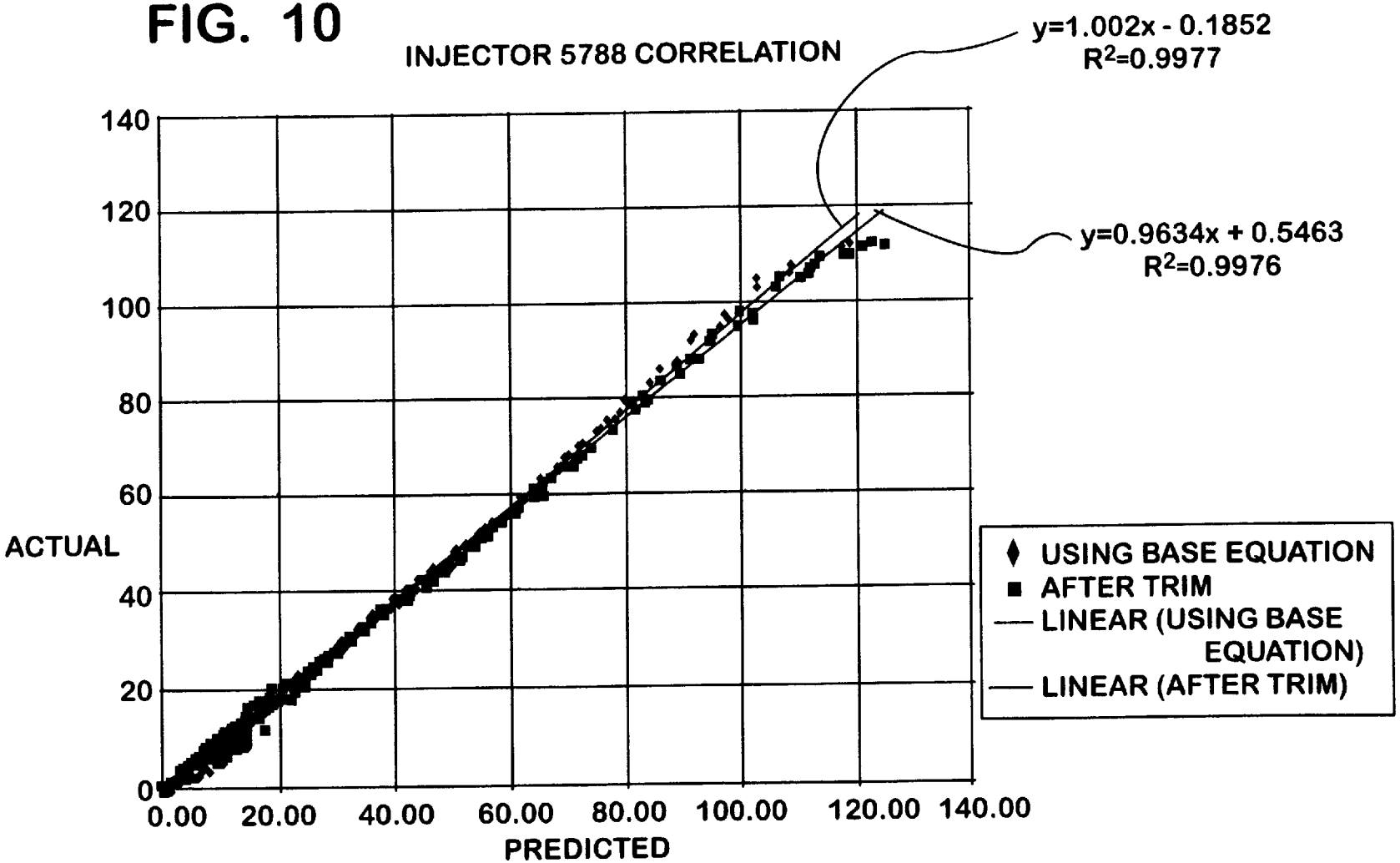
Figure 11:
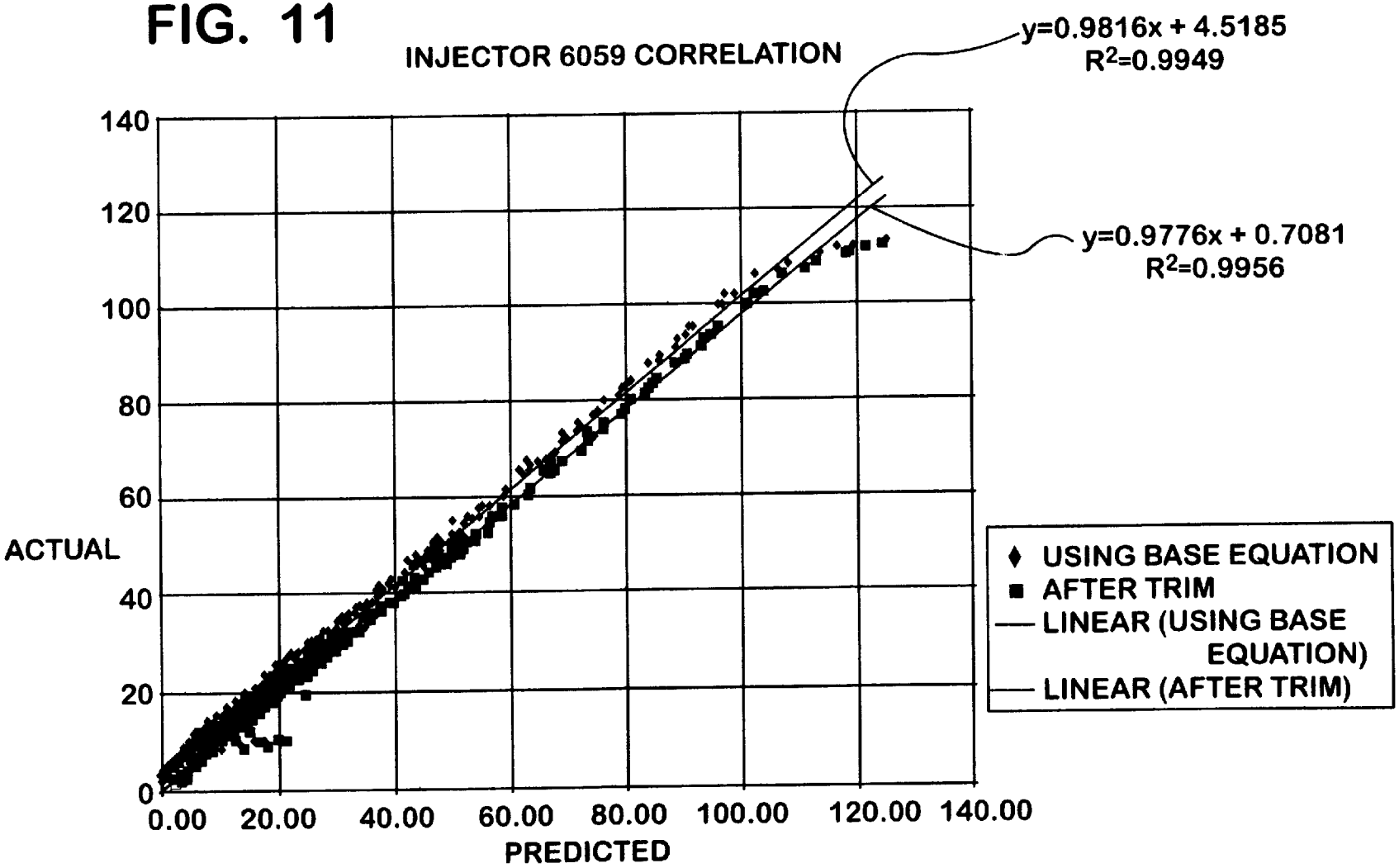

The engine control system has the capability to do this for each fuel injector. FIGS. 9, 10, and 11 show examples of how the modification of formula coefficients can secure calibration of three respective fuel injectors in an engine.

It is possible that a particular control strategy may still at times adjust the tailored formula to compensate for certain influences that call for compensation, such as cold starting for example.

Certain fuel injection strategies employ a pilot injection, followed by a main injection. Principles of the invention may be applied to either or both types of injection in such an injection strategy.

While a presently preferred embodiment of the invention has been illustrated and described, it should be appreciated that principles of the invention apply to all embodiments falling within the scope of the following claims.

What is claimed is:

1. A method of calibrating an electric-actuated fuel injector for an engine that uses injector control pressure to inject the fuel from the injector into the engine, before the fuel injector is installed in the engine, the method comprising:

electrically actuating the fuel injector with a predetermined electric actuation at a first predetermined injector control pressure and measuring the resulting quantity of fuel injected;

electrically actuating the fuel injector with the predetermined electric actuation at a second predetermined injector control pressure and measuring the resulting quantity of fuel injected; and correlating the measured quantities, the predetermined injection control pressures, and the applied predetermined electric actuation with values of quantity of fuel injected, injector control pressure, and electric actuation that are related by a predetermined multiple term mathematical formula to ascertain, for the same quantities of injected fuel at each predetermined injector control pressure, difference between the applied predetermined electric actuation and that required by the formula.

2. A method as set forth in claim 1 further including marking the fuel injector with data that defines the difference.

3. A method as set forth in claim 2 further including installing the fuel injector in an engine having a control system that contains the formula and includes one or more processors for processing the formula to calculate electric actuation of the fuel injector and modifying the formula according to the data marked on the fuel injector to calibrate the fuel injector in the engine so that the fuel injector injects fuel substantially in accordance with desired fueling data calculated by the control system and then used in the formula as the quantity of injected fuel.

4. A method as set forth in claim 3 wherein the control system calibrates the fuel injector in the engine by modifying certain coefficients of the formula.

5. A system for calibrating an electric-actuated fuel injector for an engine that uses injector control pressure to inject the fuel from the injector into the engine, before the fuel injector is installed in the engine, the system comprising:

apparatus for 1) electrically actuating the fuel injector with a predetermined electric actuation at a first predetermined injector control pressure and measuring the resulting quantity of fuel injected; 2) electrically actuating the fuel injector with the predetermined electric actuation at a second predetermined injector control pressure and measuring the resulting quantity of fuel injected; and 3) correlating the measured quantities, the predetermined injection control pressures, and the applied predetermined electric actuation with values of quantity of fuel injected, injector control pressure, and electric actuation that are related by a predetermined multiple term mathematical formula to ascertain, for the same quantities of injected fuel at each predetermined injector control pressure, difference between the applied predetermined electric actuation and that required by the formula.

6. A system as set forth in claim 5 including marking apparatus for marking the fuel injector with data that defines the difference.

* * * * *